US006568981B1

(12) United States Patent
Chang

(10) Patent No.: US 6,568,981 B1
(45) **Date of Patent: *May 27, 2003**

(54) SOFT BRICK MODULAR BUILDING CONSTRUCTION SET

(76) Inventor: James Chang, 1612 Ricky Rd., Charlottesville, VA (US) 22901

( * ) Notice: Subject to any disclaimer, the term of this patent is extended or adjusted under 35 U.S.C. 154(b) by 0 days.

This patent is subject to a terminal disclaimer.

(21) Appl. No.: 09/499,792

(22) Filed: Feb. 8, 2000

Related U.S. Application Data

(60) Provisional application No. 60/119,645, filed on Feb. 11, 1999.

(51) Int. Cl.[7] ..... A63H 33/04

(52) U.S. Cl. ..... 446/85; 446/111; 446/901; 24/306; 24/442

(58) Field of Search ..... 446/85, 901; 428/100; 273/DIG. 30; 248/205.2; 24/306, 442

(56) References Cited

U.S. PATENT DOCUMENTS

| | | | | | |
|---|---|---|---|---|---|
| 4,671,787 | A | * | 6/1987 | Widman | 128/DIG. 15 |
| 4,862,563 | A | * | 9/1989 | Flynn | 24/306 |
| 4,964,832 | A | * | 10/1990 | Bickoff | 446/901 X |
| 4,978,301 | A | * | 12/1990 | Dodge | 446/901 X |
| 5,076,288 | A | * | 12/1991 | Millard et al. | 128/869 |
| 5,136,759 | A | * | 8/1992 | Armour, II | 24/16 R |
| 5,330,379 | A | * | 7/1994 | Roh et al. | 446/85 X |
| 5,964,634 | A | * | 10/1999 | Chang | 446/85 |
| 6,049,953 | A | * | 4/2000 | McCay et al. | 24/302 |

* cited by examiner

*Primary Examiner*—Derris H. Banks
*Assistant Examiner*—Dmitry Suhol

(57) ABSTRACT

A construction piece covered at least partially with display loop fabric and having one or more double sided hook-surfaced tabs removably affixed to said fabric so as to permit the attachment of one construction piece to another.

2 Claims, 5 Drawing Sheets

SOFT BRICK MODULAR BUILDING CONSTRUCTION SET

This application claims the benefit of U.S. Provisional Application No. 60/119,645 filed Feb. 11, 1999.

FIELD OF THE INVENTION

The present invention relates to building construction pieces of varying sizes, colors, and geometrical shapes, which can be releasably joined to one another in an unlimited number of ways through the use of double-sided hook tabs and display loop fabric to form varied and interesting structures. The present invention enables users such as young children to create an unlimited number of practical and whimsical structures such as furniture, make-believe animals, and play houses for educational and entertainment purposes. The invention may also be used by others, such as by retail merchants to display products.

BACKGROUND OF THE INVENTION

Description of the Prior Art

The use of toy building blocks is known in the prior art. A patent to Brooks U.S. Pat. No. 5,458,522 shows toy building blocks for constructing toy buildings and the like and sets forth the history of the building block prior art.

Construction sets of all kinds have been developed in the prior art. Some of these kits have consisted of components which could be easily connected to one another to form larger structures, and can be disconnected. The present invention relies upon a significant modification of the hook-and-loop fastening system to provide greater adhesive strength, structured stability, ease of use, and interchangeability among construction pieces.

In the prior art, when the traditional hook-and-loop fastening system is employed to join modular construction pieces or accessories together, the hook-surfaced and loop-surfaced materials are, out of necessity, permanently affixed to the objects to be joined. See for example the prior art patents as listed:

- U.S. Pat. No. 5,458,522 Title: FABRIC FASTENER BUILDING BLOCK Inventor: James A. Brooks, III Issued Date: Oct. 17, 1995
- U.S. Pat. No. 4,710,145 Title: THERAPEUTIC DOLL FIGURE Inventor: Nancy Hall Vandis Issued Date: Dec. 1, 1987
- U.S. Pat. No. 5,458,522 Title: FABRIC FASTENER BUILDING BLOCK Inventor: James A. Brooks, III Issued Date: Oct. 17, 1995
- U.S. Pat. No. 5,348,510 Title: TOY WITH FANCIFUL INTRA-CHANGEABLE PARTS Inventor: Paul DuPont et al. Issued Date: Sep. 20, 1994
- U.S. Pat. No. 5,322,465 Title: HAND PUPPET KIT Inventor: David P. McGill Issued Date: Jun. 21, 1994
- U.S. Pat. No. 4,762,494 Title: PSYCHOTHERAPY DEVICE Inventor: Ruth E. Woods Issued Date: Aug. 9, 1988
- U.S. Pat. No. 4,504,240 Title: HAND PUPPET WITH DETACHABLE FACIAL ELEMENTS Inventor: John J. Thomas Issued Date: Mar. 12, 1985
- U.S. Pat. No. 4,722,712 Title: GEOMETRIC TOY Inventor: Katharine L. McKenna Issued Date: Feb. 2, 1988
- U.S. Pat. No. 4,937,181 Title: EDUCATIONAL DISPLAY SYSTEM Inventor: John Rogers Issued Date: Jun. 26, 1990

- U.S. Pat. No. 4,722,712 Title: GEOMETRIC TOY Inventor: Katharine L. McKenna Issued Date: Feb. 2, 1988
- U.S. Pat. No. 4,964,832 Title: MODULAR PUPPET SYSTEM Inventor: Charles Bickoff Issued Date: Oct. 23, 1990
- U.S. patent application Ser. No. 4,699,385 Title: CHESS PUZZLE BOARD AND PIECES Inventor: Bifulco Issued Date: Oct. 13, 1997

These patents show systems wherein the hook and loop material is permanently affixed to blocks or other modular pieces to releasably join the modular pieces together. Consequently, the user of the construction pieces has no discretion over where on the construction pieces to place the hook-surfaced and loop-surfaced fastening materials. Moreover, because the traditional hook and loop-surfaced materials are costly and unpleasant to the touch, manufacturers have limited the amount of hook-surfaced and loop-surfaced material affixed to the construction pieces or other objects to be joined. Manufacturers have placed the hook-surfaced and loop-surfaced materials only where it was guessed that connection between construction pieces was most likely to occur. Unfortunately, where there is no hook and loop material, the construction pieces cannot be joined together; the construction pieces can only be joined together where the fastening material is. Consequently, the number of possible construction piece configurations is limited.

The problem has been aggravated by the fact that the tabs and strips of fastening material must be located on the construction pieces such that when the two construction pieces are placed face to face, the tabs and strips of adhesive material must be of opposite types, one-hook-surfaces and one loop-surfaced. This requirement poses a problem because even if the manufacturer affixes the tabs or strips at the most likely points of attachment on the surfaces of the construction pieces, the manufacturer still must make an educated guess about which material to use where for the greatest number of successful matches between hook-surfaced or loop-surfaced tabs or strips. For the user, it can become frustrating to try to match up the hook-and loop materials when trying to join the construction pieces together.

To a limited extent, this particular problem can be mitigated by insuring that each construction piece has a combination of both hook-surfaced and loop-surfaced material at every likely point of contact such that at any place where two construction pieces touched, some hook-surfaced fabric would contact some loop-surfaced fabric. However, when this method has been used, the tabs and strips have taken on a checkerboard appearance, which is aesthetically not pleasing.

Another limitation is that because the tabs and strips or hook-surfaced and loop-surfaced material cannot be added to or removed from the construction pieces at the discretion of the user, the user cannot control the adhesive force between the construction pieces by varying the amount of hook-surfaced and loop surfaced material connecting the construction pieces together.

Another problem with permanently affixing the tabs or strips of hook and loop material to the construction pieces is that inevitably some of those tabs or strips are exposed to view on the finished structure, and they cannot be removed. Such exposed tabs or strips detract from the overall appearance of the structure formed. In addition, because the hook-surfaced material is somewhat stiff and unpleasant to the touch, permanently affixing the hook-surfaced and loop-surfaced material to the construction pieces causes the surfaces of the individual construction pieces and the finished structure to be unpleasant to the touch.

The present invention solves the above problems through the employment of double-sided hook-surfaced tabs in combination with geometrically-shaped, planar-faced construction pieces to form a superior building construction system.

Bickoff, U.S. Pat. No. 4,964,832, issued Oct. 23, 1990, shows puppets wherein body part extremities, facial features, accessories such as clothing are attached by hook and loop materials to primary body and head parts to form a "stuffed toy", doll, puppet, or marionette.

SUMMARY OF THE INVENTION

The present invention essentially comprises a construction piece of any geometrical shape with planar faces having fabric fasteners secured thereto for releasably coupling the piece to another piece. Each construction piece may be hollow or solid, such as consisting of foam material. The construction piece of the present invention is covered at least partially with display loop fabric and is accompanied by independent double-sided hook-surfaced tabs which may be removably affixed to said fabric so as to permit the attachment of one construction piece to another. In an alternate embodiment of the present invention a reinforcement strip is connected to each of said construction pieces by double-sided hook-surfaced tabs wherein, at least one side of the reinforcement strip is covered with display loop fabric.

The present invention relates to a novel device comprising relatively large, light-weigh, soft building blocks of a variety of shapes, and various fastening devices which are also of a relatively large size, where both the blocks and the fastening devices are appropriate for use by small children and infants as well as other age groups, for a variety of purposes. More specifically, primarily the blocks are preferably of a size that permits and invites users to either sit upon, stand on, lie upon, jump on, or be supported by the blocks, or which contribute structurally to the building of structures which permit and invite such above use, or which contribute structurally to the building of structures which permit the user to pass through such a structure or sit under the structure. The blocks are also primarily of a size that encourages not only fine motor skills, but also gross motor skills in the course of manipulating or arranging one or more blocks. Blocks that encourage gross motor skills in the course of manipulating or arranging one or more blocks. Blocks that encourage gross motor skills have many benefits educationally, developmentally, recreationally, and also therapeutically; in addition to the standard uses of a construction set, it is envisioned that the blocks may be used by physical and occupational therapists to rehabilitate patients through the encouragement of gross motor activities in the manipulation one or more blocks. It is envisioned that some of the block dimensions will allow the blocks to be used as protective pads, such as on floors or sharp-corned furniture to guard children from injury. The tabs and strips are oversized to prevent ingesting and may have rounded edged to eliminate sharp corners which present a risk of injury. As explained, the blocks are constructed for durability and can be easily disassembled to wash or clean the outer cover. The blocks are preferably polygonal, flat surfaced elements which makes it easy for even toddlers to place double-sided hook tabs on the flat surfaces which have a large area and this facilitates assembly of large blocks to one another. Older children can place tabs more selectively across the juncture of blocks to made a more secure connection.

Each block is sized and proportioned to be highly versatile, providing the user with a great degree of discretion over the way in which each block can be arranged in relation to other blocks. To permit such versatility, the blocks are preferably within a particular range of dimensions. The blocks are also sized and proportioned keeping in mind the practical issues of storage by the user and manufacturing cost. Preferably, the blocks have a minimum surface and are dimensioned proportionately to each other to compatibly fit together in assemblies created from the blocks. For example, the width of the cube-type block is an even multiple widthwise relative to a flat elongated block so that three cubes can be fitted on the longest flat surface of the flat elongated block.

BRIEF DESCRIPTION OF THE DRAWINGS

These and other objects of the present invention and various features and details of the operation and construction thereof are hereinafter more fully set forth with reference to the accompanying drawings, wherein.

DETAILED DESCRIPTION OF THE PREFERRED EMBODIMENT

Figure 3:
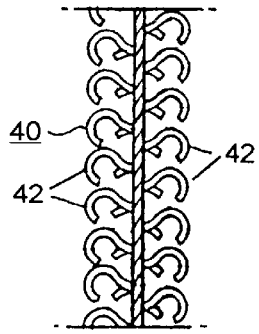
FIG. 3 is a greatly enlarged fragmentary sectional view taken on lines 3,3 of FIG. 1 schematically the construction of a double-sided hooked soft block connecting tab.
Figure 5:
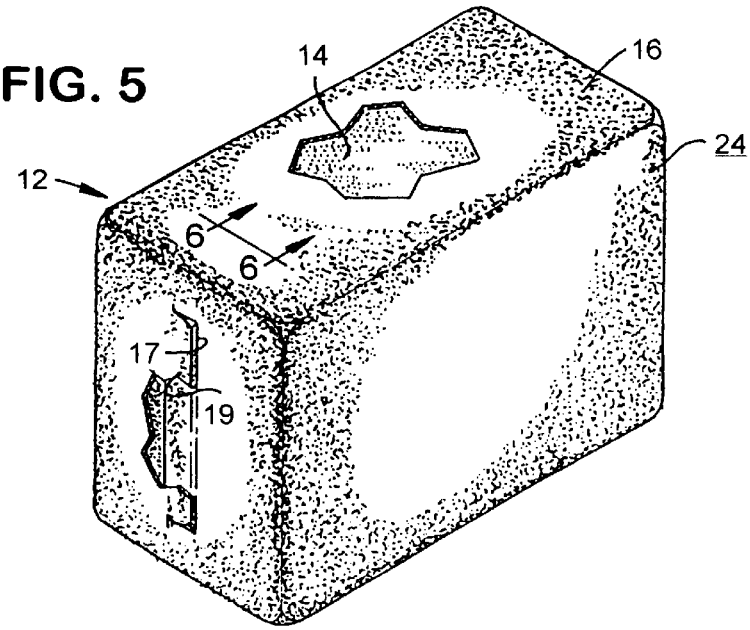
FIG. 5 is an enlarged fragmentary isometric view of the rectangular soft block shown in FIG. 1 of the drawings with portions of the drawing broken away and in section to show details of construction.
Figure 11:
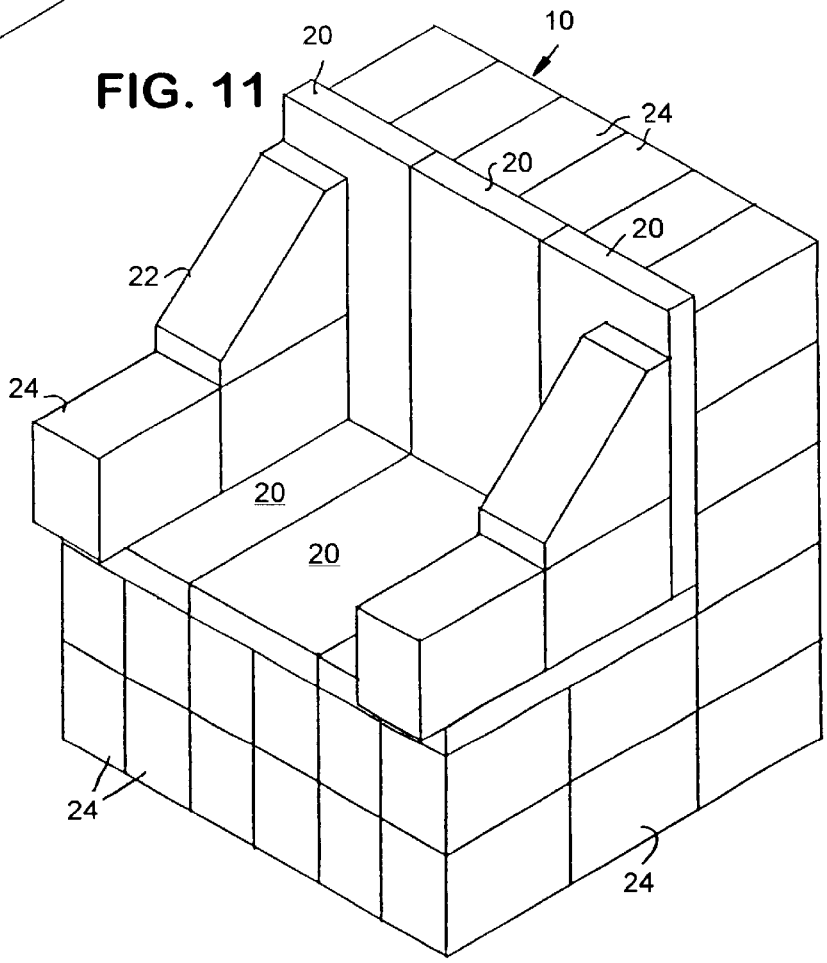
FIG. 11 is an isometric view schematically showing a structure created from the three soft block building components and double-sided hooked tabs shown in FIG. 1 the structure shown could be an arm chair or a building.
Figure 12:
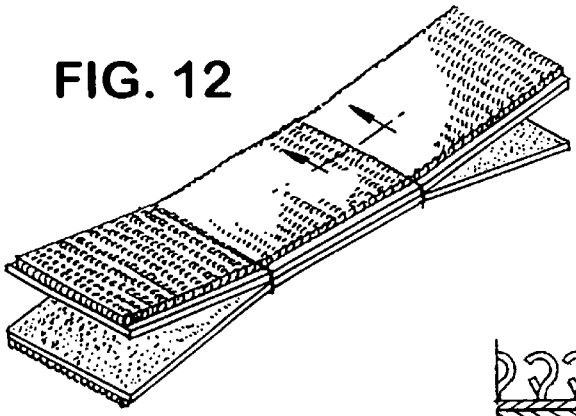
FIG. 12 is an isometric view of a modified block connecting tab comprising back to back hook surfaced strips that are joined together by means of two lines of stitching dividing the tab into three segments.
Figure 13:
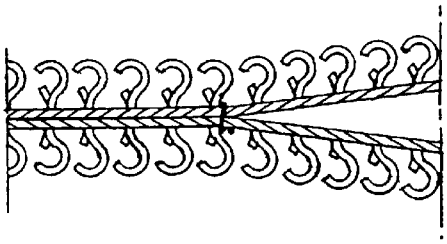
FIG. 13 is a greatly enlarged schematic sectional elevational view taken on the line 13 of FIG. 12 showing details of construction.
Figure 14A:
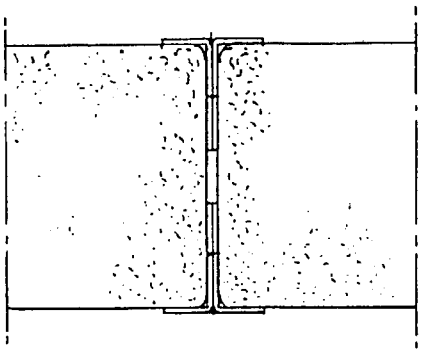
FIG. 14A is a fragmentary schematic side elevational view showing two soft blocks having their terminal ends joined together by means of back to back hook surfaced tabs such as shown in FIG. 12.
Figure 14B:
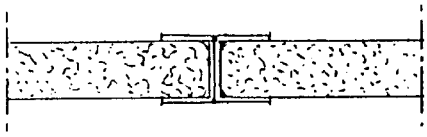
FIG. 14B is a fragmentary schematic side elevational view showing the dual surfaced hook tab shown in FIG. 12 being used to join two soft blocks in a different mode of use.
Figure 15:
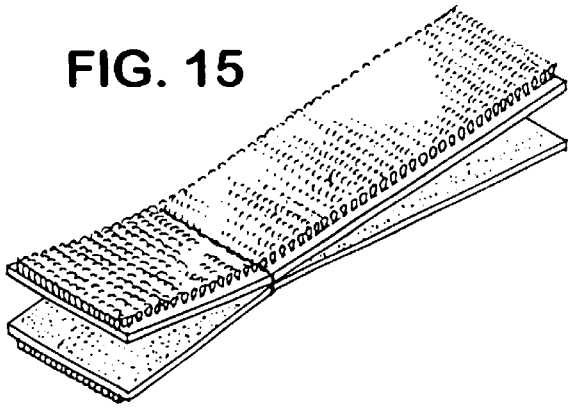
FIG. 15 is an isometric view of another modified form of soft block connecting tab comprising two hook surfaced strips joined back to back by means of a single line of stitching somewhere near one terminal end of the strip.
Figure 16:
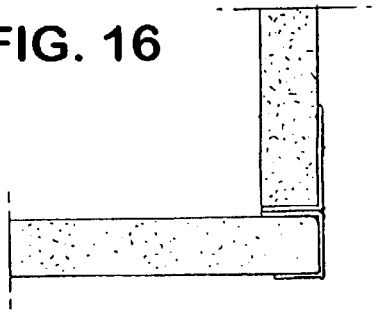
FIG. 16 is a fragmentary schematic view showing two soft blocks having their terminal ends joined together utilizing a dual hooked surface tab as shown in FIG. 15.
Figure 17:
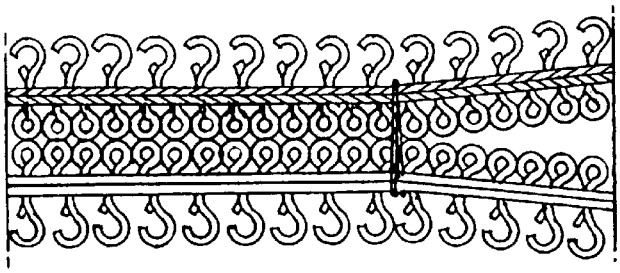
FIG. 17 is a greatly enlarged fragmentary schematic sectional view showing still another modification in that the under surface of the hook surfaced strip is provided with a loop surfaced material or some other finished fabric to provide a more cosmetic look to the hook surfaced tabs.
Figure 18:
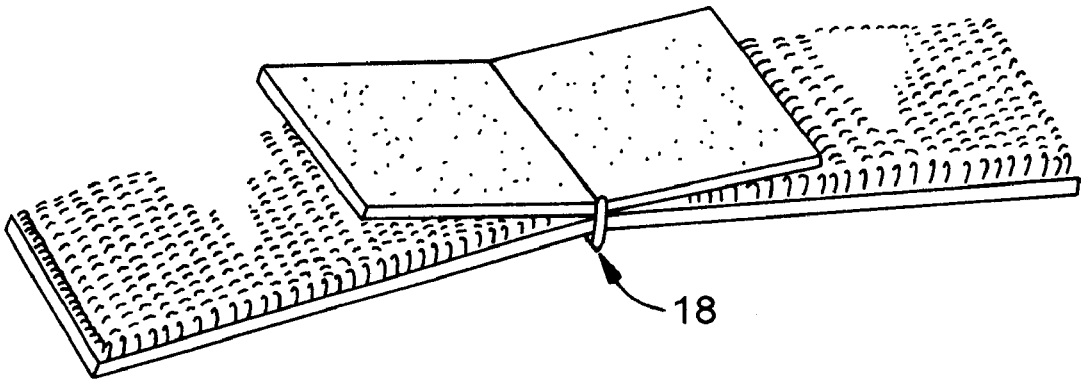
FIG. 18 is an isometric view of another modified form of soft block connecting tab comprising two hook surfaced strips of unequal length joined face to face by means of a single line of stitching dividing the tab into two segments.
Figure 19:
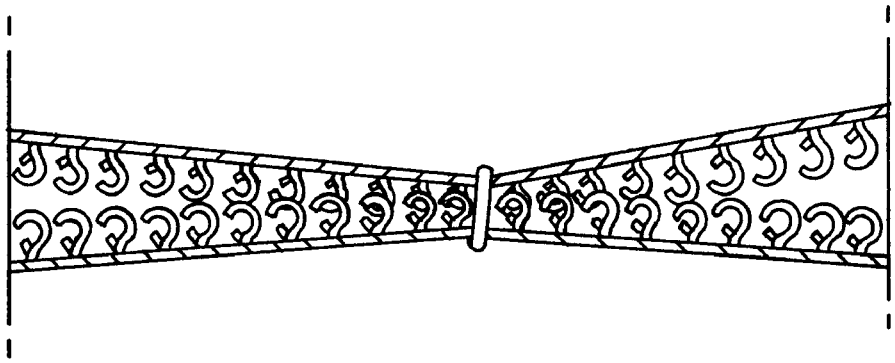
FIG. 19 is a greatly enlarged fragmentary schematic sectional view taken on line 19 of FIG. 18 showing details of construction.

Referring now to the drawings and particularly to FIG. 11 thereof, there is shown a toy structure 10 constructed with the soft block construction pieces 12 of the present invention. With reference to FIG. 5 of the drawings, each construction piece 12 essentially consists of a foam core 14 and an outer cover 16 of a material to form a bond with hook-surfaced material. The outer cover is, preferably made of display loop fabric. The fabric 15 as illustrated in FIG. 3A comprises a backing material 17 and a dense population of loops 19 projecting from one face of the backing 17. As a fabric, it is usually soft to the touch, may come in wide swaths, is attractive, and may be worked like any other fabric. Display loop fabric is often used for display boards, hence the name. Display loop fabric has many textures, including but not limited to that of velvet or felt, burlap, or office carpet. The construction pieces 12 or blocks are preferably polygonal and have flat planar faces F. The embodiments illustrated comprises a three-dimensional slab-shaped, rectangular solid 20, a five-sided wedge shape 22 or an essentially six-sided block shape 24, with each significant face F being a flat plane rather than curved. The outer covering 16 of each construction piece 12 can be permanently affixed to the core (see FIG. 6C), or can be made removable by a slit 17 and flap 19 as shown in FIG. 5. The outer covering 16 can be of a fabric separately manufactured and then placed over the core 14, or it can be applied directly onto the core 14 as part of the manufacturing process without being separately fabricated. The outer covering 16 can be affixed to the core 14 by a variety of methods, such as by sewing the outer covering so it can be pulled over the core, or by gluing or laminating the covering onto the core. When the outer covering is to be pulled over the core, the core may first be covered with a thin flexible plastic sheath 30 or its functional equivalent to allow the outer covering to slip over the core 14 more easily (see FIG. 6B). The core may also contain or consist of a structural support mechanism such as one or more springs or air-filled bladders or chambers.

For the present invention, the construction pieces 12 are covered partially or entirely by this display loop fabric 15 or its functional equivalent. These construction pieces 12 are joined together through the employment of double-sided hook-surfaced tabs 40 which are independent of the construction pieces 12 rather than being permanently affixed, and which may be of varying lengths and widths. All potentially connecting faces F of these construction pieces 12 are flat-surfaced (on a single plane) rather than curved, to permit maximum contact area between the faces of the construction pieces 12 to be joined.

Figure 8:
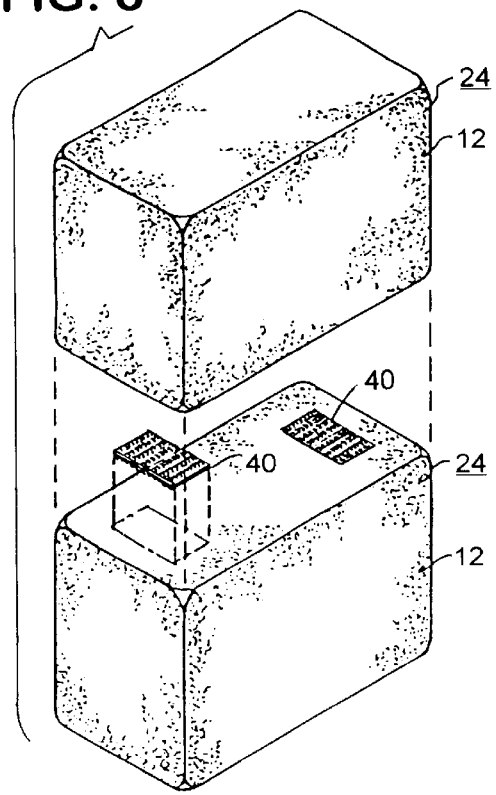
FIG. 8 is an exploded isometric view illustrating how two soft blocks may be joined together by the use of the double-sided hook-surfaced tabs.
Figure 9:
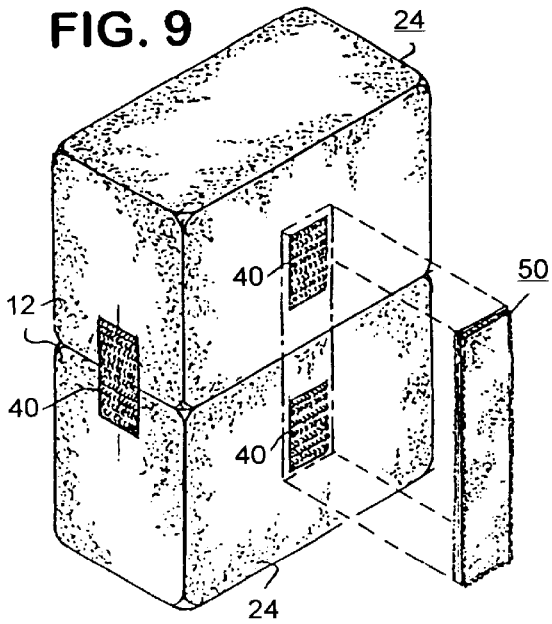
FIG. 9 is an isometric view of two soft blocks joined together as shown in FIG. 8 and then juncture reinforced by the application of a double-sided reinforcement strip and by a double-sided hook-surface tabs.
Figure 10:
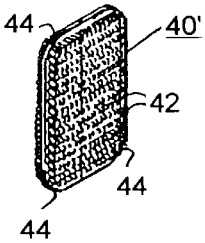
FIG. 10 is an isometric view of a slightly modified double-sided hooked tab having rounded edges to eliminate sharp corners.

The tabs 40 are unique in two ways. First, instead of having the myriad tiny hooks 42 on only one side, the tabs 40 are double-sided, having these tiny hooks 40 on both sides. Second, with reference to FIGS. 1, 2 and 8 instead of being permanently affixed to the object to be attached, these tabs 40 are independent of the construction pieces 12, removably placed in between construction pieces 12 at those location on each piece where the user desires the construction pieces 12 to be joined with reference to FIG. 9. The tabs 40 can be manufactured into longer strips so that instead of going in between construction pieces 12, the tabs 40 can be placed on the outward adjacent faces of two adjacent construction pieces 12, which may be easier for younger children to do, and can at times be a more practical and stronger method of connection. Also, a modified tab 40' shown in FIG. 10 of the drawings has rounded corners 44 to prevent a possible injury due to a pointed edge. Used in this fashion, it is not necessary that the tabs be double-sided but instead may have hooks in only one side, and may have loop-surfaced material on the opposite side.

Figure 1:
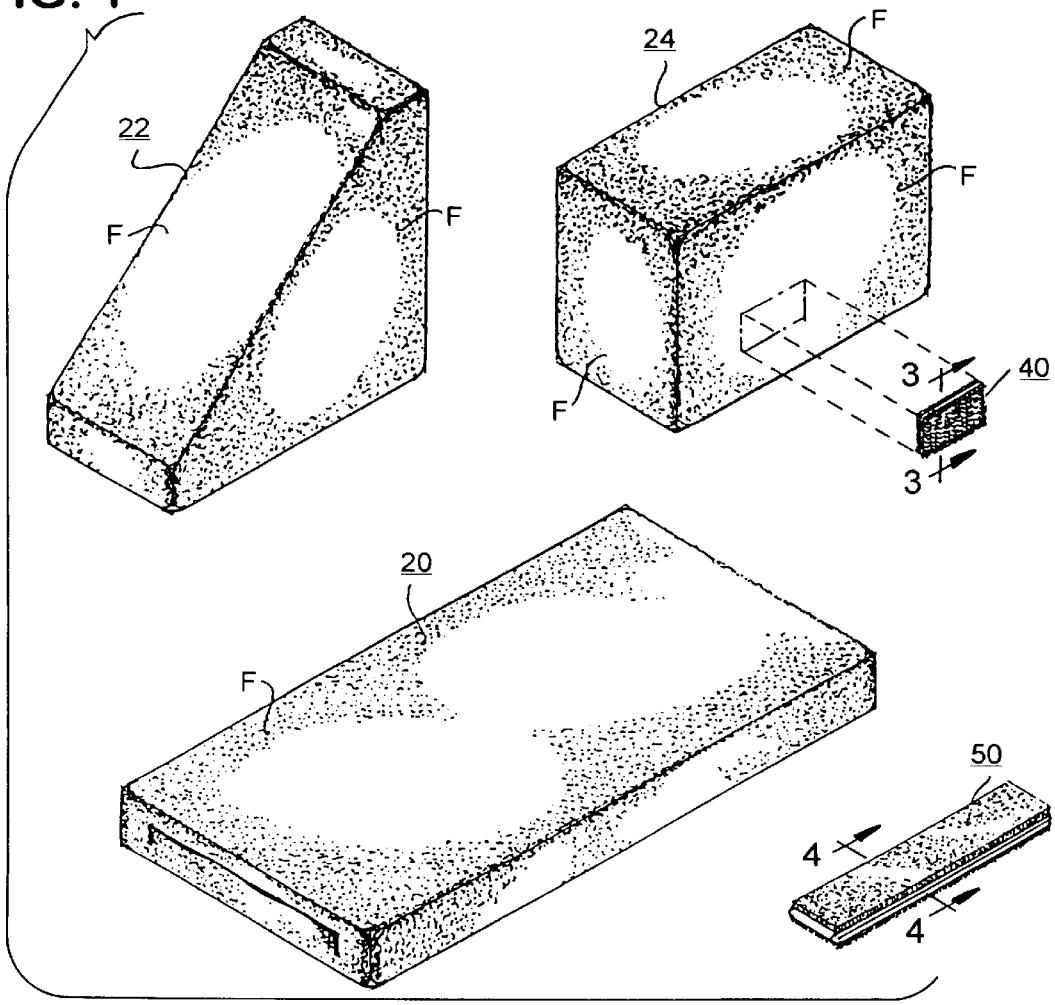
FIG. 1 is an isometric view of three soft block building components incorporating the construction pieces of the present invention also shown is a double-sided hooked surface tab for selectively joining the soft blocks together and a double-sided looped fabric reinforcing strip.
Figure 2:
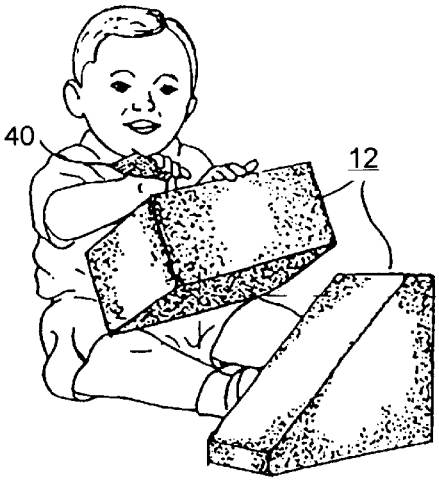
FIG. 2 is a perspective view showing a small child holding a very light soft block of some size, engaged in applying a double-sided hooked surface tab to the soft block in hand prior to maybe connecting the triangular soft block to the rectangular soft block.
Figure 4:
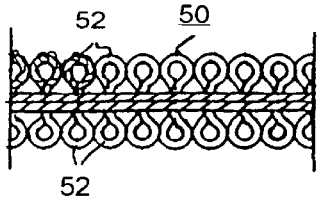
FIG. 4 is a greatly enlarged fragmentary sectional view taken on the line 4,4 of FIG. 1 showing schematically the construction of a double-sided looped soft block reinforcing strip.

To strengthen the adherence between construction pieces, reinforcement strips 50 may be used with reference to FIGS. 1 and 4. These reinforcement strips 50 are flat strips of material consisting of two strips of display loop fabric fused or joined back to back, through such means as sewing resulting in double-sided display loop fabric strips 52, or a strip of fabric in which one side is covered with display loop fabric 15 and the other side is covered with some other fabric. Preferably, the reinforcement strips 50 are approximately 2 inches wide and 4 to 8 inches long, but may be longer. They are employed by attaching one end of the reinforcement strip 50 to a construction piece 12, and then attaching the other end of the strip 50, on the same side of the strip, to another construction piece 12, through the use of double-sided hook tabs 40. The lateral friction (shear friction) between the construction pieces 12, the double-sided hook tabs 40, and the reinforcement strips 50, results in a greatly enhanced adherence between the construction pieces 12 themselves.

The advantages of the building construction system of the present invention are manifold. The system is simple and easy to use because it allows for the placement of tabs wherever needed resulting in an infinite variety or configurations and consequently, even young children can use the system. The user can vary the adhesive force between the construction pieces 12 as needed by varying the number of double-sided tabs 40. Exposed surfaces F of the construction pieces 12 do not have affixed to them unsightly and rough-surfaced tabs or strips of adhesive material since the double-sided tabs can be removed when not in use, allowing for an attractive and pleasantly soft surface. There is no need for the manufacturer to make an educated guess as to the best placement of hook-surface material since the tabs are not permanently affixed but instead is applied, removed, and reapplied at discretion of the user. This is a more cost effective use of hook-surfaced material since the materials is only used where needed.

The construction pieces in the present invention have flat, planar faces such that when two construction pieces are placed together, any two faces placed side-by-side will be very close together or touching, and their edges will be linear, allowing for a maximum number of locations where hook-surface tabs 40 can be placed on the adjacent faces F or edges of the construction pieces.

Accessories such as a steering wheel for a make-believe car, a burner element for a make-believe stove, or letters of the alphabet for a sign-board, may be attached to the construction pieces, either by means of hook-surfaced material permanently affixed to the accessories, by use of the double-sided tabs, or without the use of any hook-surfaced material whatsoever, as in the application of letters of the alphabet made out of felt material. When the soft core 14 of the construction pieces 12 is made from a soft depressible material it provides a comfortable sitting or lying arrangement.

Preferably, when the construction piece has five faces F, all of the sides are even, flat and level (on a single plane, as opposed to convex, concave or curved). Preferably, when the construction piece has six or more faces, at least six of the faces are substantially even, flat and level.

Preferably, the core 14 is made of polyurethane foam or similarly soft, depressible material and is surrounded substantially or completely by an outer covering 16 comprising preferably material known in the fastener industry as display loop. For each and every construction piece's face which is primarily meant to have significant contact with other construction pieces, preferably at least 20% of the outer covering's surface is comprised of display loop fabric or a functionally equivalent material, in any configurations which are convenient for manufacture and cost effective.

In the case of wedge-shaped construction pieces, preferably loop-surfaced fabric or material or its functional equivalent is affixed preferably to five sides of the construction piece or of the outer covering. In the case of construction pieces with six or more sides, loop-surfaced fabric or material or its functional equivalent is affixed preferably to six or more sides of the construction piece or to six or more sides of the outer covering.

The outer covering of each construction piece can be designed to be affixed permanently to the core or can be designed to be removable from the core for such purposes as cleaning in a clothes washer.

Between the core 14 and the outer 16 covering it may be preferable to place a thin, flexible plastic sheath 30 to allow the outer covering to slip over the core more easily. (See FIGS. 6B and 7.)

When the outer covering fills out, preferably it results in the same dimensions as the construction piece above, and results in the same limitations on placement of loop-surfaced material on the number of faces and characteristics of faces.

Double-side Hook Tabs

The hook tabs are simply flat tabs that have hook surfaces on both sides (double-sided), which are preferably formed by permanently fusing or joining two pieces of hook-surfaced material in a back-to-back configuration, or by manufacturing a single piece of double-sided hook-surfaced material. The tabs may be of varying lengths and widths but are preferably about $\geqq 1.25$ inches wide and >2 inches long. The tabs may preferably be made with rounded corners instead of sharp, 90 degree angled corners, or be made from a soft cloth-like material.

Reinforcement Strips

The reinforcement strips are flat strips of material consisting of two strips of display loop fabric fused or joined back to back, through such means as sewing, resulting in double-sided display loop fabric strips. Preferably, the reinforcement strips are approximately 2 inches wide and 4 to 8 inches long, but may be longer. The reinforcement strips may also be made to have only one side composed of display loop fabric, with the other side made of some other material. It is to be understood that the present invention is not limited in its application to the details of construction and to the arrangement of the components set forth in the following description or illustrated in the drawings. Those skilled in the art will appreciate that the conception upon which this disclosure is based my readily be utilized as a basis for designing of their structures, methods and systems for carrying out the several purposes of the present invention. Therefore the following claims are to be regarded as including such equivalent constructions insofar as they do not depart from the sprit and scope of the present invention.

It is to be understood that the present invention is not limited in its application to the details of construction and to the arrangement of the components set forth in the following description or illustrated in the drawings. Those skilled in the art will appreciate that the conception upon which this disclosure is based may readily be utilized as a basis for designing of their structures, methods and systems for carrying out the several purposes of the present invention. Therefore the following claims are to be regarded as including such equivalent constructions insofar as they do not depart from the sprit and scope of the present invention.

Figure 6A:
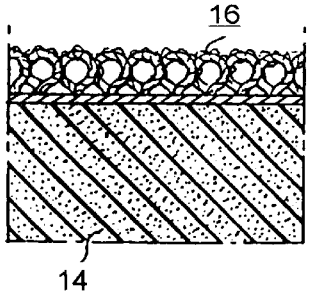
FIG. 6A is an enlarged fragmentary schematic sectional view taken on the line 6A, 6A of FIG. 5 showing the foam core having a looped fabric sheath.
Figure 6B:
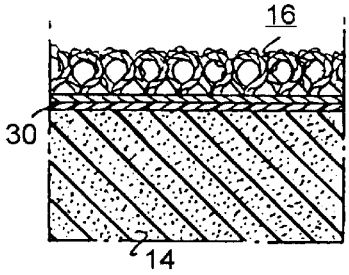
FIG. 6B is a view similar to FIG. 6A but showing the foam core encased in a plastic cover and the foam core and plastic cover encased in a looped fabric sheath.
Figure 7:
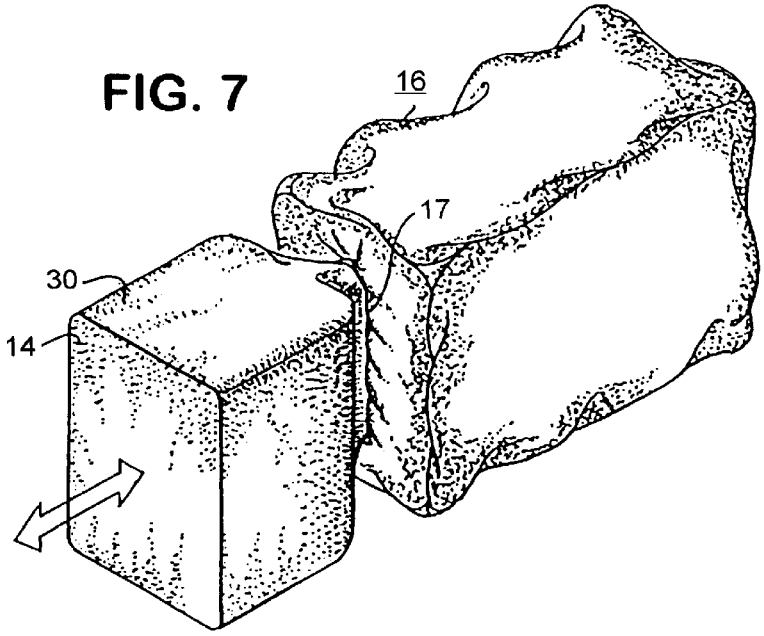
FIG. 7 is an enlarged isometric view showing how the foam core of the soft block may be both removed from its outer fabric sheath in order to wash the outer fabric cover or reinserted in the fabric sheath when cleaned.

In accordance with another embodiment of the present invention shown in FIG. 6B, a plastic sheet 30 or functionally-equivalent material sheathing surrounds the foam core 14 and closely embraces the same to facilitate assembly into the outer cover 16. It also facilitates quick and easy removal of the core 14 element when the cover 16 requires washing or cleaning. The protective waterproof sheathing 30 between the foam core 14 and the outside cover 16 prevents the entry of infectious germs and diseases into the foam core 17. The plastic sheathing 30 may have one or more openings an opening to allow the passage of air from the foam core 14 to the surrounding environment and from the surrounding environment back into the foam core 14.

Figure 6C:
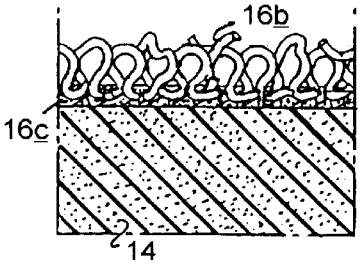
FIG. 6C is a fragmentary section view similar to FIGS. 6A and 6B but showing a modification in that the foam care is covered by flocked short looped fabric pieces cemented to the foam core.

A modification in accordance with the present invention is shown in FIG. 6C. The block assembly includes a core 14 made of foam material and a loop fabric ends 16B bonded directly to the other peripheral surface of the foam core 14 by a suitable bonding cement such as an epoxy 16C.

In accordance with the present invention, the construction piece may have embodied therein means for playing music or generating sound such as police siren or animal sounds. Further, the construction pieces may have means for emitting light.

As discussed previously, the present invention provides large, light weight, soft building blocks appropriate for infants and young children as well as all other age groups which can be assembled easily to produce large assemblies such as a chair shown in the drawing which can accommodate a child. It has been found that when the blocks are within given parameters, they provide optimum play value and greater use, versatility and flexibility. For example, for the rectangular slab-shaped block element Bs with the height or X dimension of the construction piece shown in FIG. 1 is preferably greater than 1.25 inches and less than 3 inches. The length and width designated by the letters "Z" and "Y" respectively, are preferably in the range as follows:

Y×Z is at least about 81 square inches

Y×Z≦about 1440 square inches.

For the construction piece or building block Br shown in FIG. 5, the X, Y and Z dimensions are preferably in the relationship as follows:

X is equal to or greater than 4 inches

Y is approximately equal to or greater than X

Y is approximately equal to or less than 2X

The product of X×Y×Z is equal to or less than approximately 2744 cubic inches, and the product of X×Y×Z is equal to or greater than approximately 126 cubic inches. These volumetric relationships apply for other polygon-shaped blocks.

The cube building block Bt is preferably equal to or less than approximately 2744 cubic inches and equal to or greater than approximately 125 cubic inches.

In the preferred form of construction piece which has been described as a cube shown in FIG. 5, the Z dimension is preferably greater than the Y dimension or Y is preferably greater than X.

Even though particular embodiments of the present invention have been illustrated and described herein, it is not intended to limit the invention and changes and modifications may be made therein within the scope of the following claims. For example, the construction pieces may be used in association with a platform or base having wheels where the platform or base has a flat planar surface to which the planar hook surface or loop surface material which allows constructions pieces to be readily affixed to the platform or base to form a chassis of a truck or automobile. The wheeled platform or base may include a steering mechanism so that in effect the platform serves generally as a base for miniature scale play vehicles. Further, the platform assembly may include a wind-up electric or other motor or engine for purposes of provide the power of a locomotion. The motor or engine may be housed in the block itself.

There is shown in FIGS. 12–19, inclusive, a further modified form of connecting tabs for construction pieces of the type disclosed and shown herein. The further modified invention relates to a significant modification of the hook-and-loop fastening system to provide more adhesive strength in those situations where hook-surfaced connecting tabs are used to join together two items covered by loop-surfaced material. The further modified invention also includes other modifications to the construction pieces themselves.

The hook-and-loop fastening system traditionally has consisted of two separate components. One of the components is a material that has as its surface numerous tiny flexible hooks which are bunched closely together to form a dense carpet of tiny hooks. The other component is a material that has as its surface numerous tiny loops which are bunched together also. These two component are made out of a variety of materials, such ac nylon, polyester, or polypropylene, but also including Nomex R, Teflon R, non-corrosive metal, and nylon impregnated with silver. When the two component materials are pressed together, the numerous tiny hooks grab or latch onto the numerous tiny loops, causing the surfaces of the two materials to adhere to each other. This adherence between the materials is designed to be broken by physically pulling the two materials apart, causing the numerous tiny hooks to release from one another. Significantly, the two materials can be joined together and separated repeatedly.

The hook-surface material and loop-surfaced material, often in the form of squares or strips, are usually permanently affixed (typically through such means as sewing or pressure sensitive adhesives) onto other materials or objects to enable these other materials or objects to be joined together or separated at will at those points where to hook and loop material is located. As a result, objects to be joined can be attached, separated, and reattached at the discretion of the user.

The traditional hook-and-loop fastening system has been used to join modular construction pieces together by permanently affixing hook-surfaced and loop-surfaced material to the construction pieces so that the construction pieces can be attached where the hook and loop material is located. However, by permanently affixing the hook and loop material onto the construction pieces, previous systems have run into the problem of being forced to try to determined where best to locate the look and loop material on the construction pieces such that the user can easily and practically configure the blocks. The present invention provides of a modified hook-and-loop system which overcame the problem of having to figure out optimal patterns for permanent placement of hook-and loop material.

The modified system can be described briefly as follows. Each construction piece consists of a geometrically-shaped preferably foam core that is covered by loop material, known as display loop fabric, which functions as the loop-surfaced material in the hook-and-loop fastening system. The loop material may cover the entire surface of the construction piece. The construction pieces are connected together through the placement of independent double-sided, hook-surfaced tabs in between the construction pieces, or across adjacent faces of the construction pieces. Since the construction pieces are covered by loop-surfaced fabric, the double-sided, hook-surfaced tabs may be placed anywhere on each block, providing maximum discretion to the user regarding where to connect construction pieces together. All that the user needs to do is to place connecting tabs between or across construction pieces where the user wants the construction pieces to be connected together. Also, each face of each construction piece is essentially planar to allow for maximum stability.

Because the connecting tabs are independent of the construction pieces (i.e., not affixed to the construction pieces permanently), the tabs can be applied and removed at the user's complete discretion. By giving the user complete discretion over when and where the hook material is used, the system provides a most efficient and inexpensive use of hook material. Other advantages of having removable double-sided tabs include simplicity and ease of use; an infinite variety of construction piece configurations; discretion over how much adhesive force to employ, as determined by the number of tabs used; the absence of unsightly and rough-surfaced hook tabs on exposed surfaces since tabs can be removed when not in use; and avoiding the need by manufacturers to guess where best to affix hook material onto the surfaces of the construction pieces since the placement of the tabs is determined by the consumer on an as-needed basis.

The following modifications are further improvements over the traditional hook-and-loop fastening system. One of the most significant improvements increases the adhesive strength of the double-sided tabs when stresses are place upon structures made out of the construction pieces and connecting tabs, such as from structures being sat upon, pushed, hit, or moved, or simply from the pull of gravity.

To understand how the inventor's present improvements increase adhesive strength, first one needs to understand the two primary kinds of stresses upon the connecting tabs: peeling stresses and shear stresses. With hook-and-loop fasteners, peeling stress is caused by an external force applied to the connection that tends to pull the hook-and-loop materials directly away from each other, in completely opposite directions. Shear stress is caused by an external force applied to the connection that tends to pull the hook-and-loop materials in opposite but parallel directions.

Peeling stresses are harder for hook-and-loop fasteners to resist in part because the peeling force generally pulls on only a limited number of individual hooks and loops at any given time, affording relatively little resistance and thereby making it relatively easy to break apart the connections between the hooks-and-loops. As some hooks and loops disengage, other hooks and loops further on down along the connection are subjected to the same peeling stress and also become disengaged. This process continues until the entire surface of hooks disengages from the entire surface of loops. In contrast, sheer stresses are easier for hook-and-loop fasteners to resist because the entire multitude of hooks are stressed at the same time, which allows all of the hooks and loops to share the load and resist the stress in unison. The greater the number of hook and loop connections resisting the pulling force, the higher the resistance, and the harder it is to break the connection between the hook and loop materials as a whole.

The inventor believes that another dynamic that may be at work is that when the hook and loop is pulled apart directly away from each other (peeling stress), the pressure placed on any given individual hook by the pull of the mated loop is at the top, curved part of the hook, away from the base of the hook (the base being where the hook is anchored to the hook-surfaced strip). At the curved part, resistance is weakest since the only force resisting the pull is the force that wants to keep the curved part of the hook from unbending. And since the pressure is straight away from the base of the hook, the base cannot provide any supporting leverage against the stress. When the hook and loop is pulled in opposite but parallel directions (shear stress), the pressure placed on any given individual hook by the pull of the mated loop is closer down the stem toward the base of the hook, at a proximity to the base that gives the hook supporting leverage from its base, thus creating more resistance in the hook against the pull of the loop. The closer the pressure is to the base, the more leverage there is to resist the pull of the loop.

The angle of the forces upon the respective hook and loop play a large role in determining whether the hooks can resist in unison or will be pulled away, and in determining where on each individual hook each individual loop is pulling, whether it is at the top of the curve, or somewhere closer to the base.

One more dynamic is that when resisting shear stress, even as some hooks and loops are disengaged by the stress, those disengaged hooks and hoops have the opportunity to reengage with other hooks and loops as the two materials are pulled across one another. They do not have this opportunity when resisting peeling stress.

Shifting the stress from peeling stress to shear stress is a desirable goal because hook-and-loop fasteners resist shear stresses much better than they do peeling stresses. The further modifications in the design of the connecting tabs accomplish that goal.

To understand how the goal is achieved, it is helpful to understand how the prior connecting tabs react to stresses placed upon them. The prior tabs 40, as depicted in FIG. 1, are preferably two hook-surfaced strips placed back-top-back so that the hook surfaces face outward, with the strips joined along their entire surfaces by any method such as through application of glue or another adhesive agent, or through sewing. The two hook-surfaced strips in that preferable straight-tab formation could not be pulled apart at any point.

To connect construction pieces together, the straight tabs are used in two ways. They can be placed in between construction pieces or they can be placed across the faces of adjacent construction pieces. When straight tabs are placed in between blocks, the primary stress placed upon the connection between the blocks are the straight tabs is a peeling stress.

Consequently, the connection is relatively easily broken. Notably, this is also the case for those systems that use the traditional hook-and-loop system on construction pieces, where the hook and loop is permanently attached to planar surfaces.

When the straight tabs are placed across the faces of adjacent construction pieces, both shear and peel stresses result upon the connections. External forces applied to the construction pieces, such as moving the construction pieces, made the construction pieces want to pull directly away from each other, which makes the loop surfaces of each construction piece tend to want to pull across the tabs, with the force being directed parallel to the surfaces of the tabs as a shear force. But, external forces, if great enough to overcome the friction between the two adjoining construction piece faces, will also exert a peeling force upon the connections, when the construction pieces try to slide against each other. These connections are stronger than those where two tabs are placed in between construction pieces; however, the further modified tabs, which will now be discussed, create even stronger connections by seeking to eliminate peel forces as much as possible.

The present connecting tabs are similar to the straight tabs in that they are preferably comprised of two hook-surfaced strips placed back-to-back so that the hook surfaces face outward. However, instead of being joined together along their entire surfaces, the two hook-surface strips are only joined together along a portion of their surfaces such that the two back-to-back strips are separated and separable on at least one end of the connection tabs, and often on both ends. The two hook-surfaced strips are joined together preferably by sewn stitches, ultrasonic welding, glue or similar methods, running across the width of the hook-surfaced strips, as opposed to running down the length of the strips. Depending on the desired effect, the hook-surfaced strips may be joined only along a single line of stitches or welding or other means of attachment, or they may be joined along a more substantial surface area of the two strips, possibly by using two lines of stitches or welds or other means of attachment. The end result is connecting tabs with hook strips that can be separated along one or both ends.

The advantage of a connecting tab being comprised of two back-to-back strips that can be separated is that it enables the connecting tab strips to wrap around the objects being joined. In the case of construction pieces, it allows the strips to wrap around the corners, thus enabling the strips to grip onto more than one face of a given construction piece. Often, both of the blocks being joined together have a strip wrapped around more than one face. The advantage of the connecting tab gripping at least two faces of a given construction piece is that at all times, regardless of the direction of the force from an external stress, the force along at least part of the junction between the connecting tab and the construction piece surface is a shear force. Consequently, the connecting tab has a much stronger grip on the construction pieces, and the construction pieces in turn are much more strongly joined together.

Moreover, the tab strips can often be wrapped around the construction piece faces so that the external force actually presses the construction piece directly against the tab, creating extremely strong bonds. Structures can be built in such a way as to maximize the number of these types of connections. These connections can be especially useful by taking advantage of the force of gravity to allow the weight of a given construction piece to press a connecting tab into the face of another construction piece, making a strong bond.

The connecting tabs may be fabricated in other ways, so long as the alignment of the hook-surfaced strips are the same as above described when the connecting tabs are employed to connect construction pieces together.

For example, the tabs may also preferably be comprised of face-to-face hook-surfaced strips instead of back to back.

These connecting tabs need not be limited in the application to construction piece sets. They may also conceivably be used to join together any number of other items to which loop-surfaced material is attached, such as dividing walls, display panels, and shelving units.

One of the major advantages of these modified connecting tabs is their simplicity, which allows them to be easily manufactured, easily packed or stored, and easily employed.

Other improvements to the prior system developed by the present inventor include the following.

For fire safety purposes, it may be advantageous to use fire-retardant foam as the core of the construction pieces, or to place a fire-retardant barrier or sheathing over the foam core, either separate from the construction piece cover, or as an integral part of it. Such an improvement would reduce the danger of construction pieces catching on fire, or from becoming a contributing fuel source in the event of a fire.

For hygienic purposes and other use, it may be advantageous for the construction pieces to have a waterproof outer covering which has loop-surfaced material over all or a portion of each of the construction piece faces.

It may be advantageous to have computers or microprocessors or chips contained inside of the core or cover or attached onto the core or cover or affixed onto any part of a construction piece.

When a construction piece is generally rectangular and tabular in shape and not very thick, and when the two largest faces with the greatest amount of area are essentially planar, and preferably when the construction piece thickness does not exceed three inches, the faces with the smaller areas comprising the thickness of the construction piece may be rounded instead of planar. Although planar faces provide more stability, the faces may be rounded without affecting the finctionality much because the thinness of the faces allows the instability of the faces to be overcome by the face that the modified connecting tabs can wrap round the faces, and by the fact that the faces can be compressed into adjoining block faces in spite of the curvature.

In the case of all of the construction pieces, some minimal curvature at the edge of the block faces can be tolerated without compromising the stability of the block structures.

What is claimed is:

1. A kit for building structures from block-like construction pieces comprising a plurality of construction pieces, each piece having a core made of resilient flexible foam material and having a plurality of planar faces, an outer cover snugly fitting over and completely covering the outer peripheral surface of the foam core made at least in part of a looped fabric and a plurality of tab devices for lockingly engaging with the looped fabric so that the construction pieces may be releasably assembled to one another, each tab device comprising: at least two strips; means of connecting said strips along at least one line extending widthwise or lengthwise of the strips to define at least one hinge point thereby providing a connecting tab wherein the strips can be separated at least at two ends to define at least four legs, wherein each leg contains hooks on at least one side, and wherein the hook surfaces of the legs can be attached to the complementary loop surfaces of the objects being joined to connect them in a predetermined array.

2. A kit for building structures from block-like construction pieces comprising a plurality of construction pieces, each piece having a core made of resilient flexible foam material and having at least five planar faces, an outer cover snugly fitting over and completely covering the outer peripheral surface of the foam core made at least in part of a looped fabric and a plurality of tab devices for lockingly engaging with the looped fabric so that the construction pieces may be releasably assembled to one another, each tab device comprising: at least two strips; means of connecting said strips along at least one line extending widthwise or lengthwise of the strips to define at least one hinge point thereby providing a connecting tab wherein the strips can be separated at least at two ends to define at least four legs, wherein each leg contains hooks on at least one side, and wherein the hook surfaces of the legs can be attached to the complementary loop surfaces of the objects being joined to connect them in a predetermined array.

* * * * *